US006290748B1

(12) United States Patent
Jha et al.

(10) Patent No.: US 6,290,748 B1
(45) Date of Patent: Sep. 18, 2001

(54) $TiB_2$ PARTICULATE CERAMIC REINFORCED AL-ALLOY METAL-MATRIX COMPOSITES

(75) Inventors: Animesh Jha, Geeds (GB); Stuart M. Cannon, Mulgrave (AU); Chris Dometakis, London; Elisabeth Troth, Cresford, both of (GB)

(73) Assignee: Merck Pateng GmbH (DE)

( * ) Notice: Subject to any disclaimer, the term of this patent is extended or adjusted under 35 U.S.C. 154(b) by 0 days.

(21) Appl. No.: 08/930,353

(22) PCT Filed: Mar. 23, 1996

(86) PCT No.: PCT/EP96/01290

§ 371 Date: Sep. 30, 1997

§ 102(e) Date: Sep. 30, 1997

(87) PCT Pub. No.: WO96/30550

PCT Pub. Date: Oct. 3, 1996

(30) Foreign Application Priority Data

Mar. 31, 1995 (GB) ..... 9506640

(51) Int. Cl.[7] ..... C22B 21/00; C22C 21/00

(52) U.S. Cl. ..... 75/684; 75/309; 420/590

(58) Field of Search ..... 420/590, 580; 75/309, 310, 10.19, 14, 678, 682, 684, 685; 266/207, 208; 204/164

(56) References Cited

U.S. PATENT DOCUMENTS 2,255,549 * 9/1941 Kruh ..... 75/10
3,318,684 * 5/1967 Gernes et al. ..... 75/678
4,372,780 * 2/1983 Madelin ..... 75/14
4,751,048 * 6/1988 Christodoulou et al. ..... 420/590

(List continued on next page.)

FOREIGN PATENT DOCUMENTS

688880-A * 12/1995 (EP) .
1431882-A * 4/1976 (GB) .
WO-93/05189-A * 3/1993 (WO) .

OTHER PUBLICATIONS

Patent Abstracts of Japan vol. 012, No. 398 (C–538), Oct 21, 1988 & JP,A,63 140059 (Nippon Light Metal Co Ltd), Jun. 11, 1988.*

Database WPI Section Ch, Week 8520 Derwent Publications Ltd., London, GB; Class M26; AN 85–120885 XP002007520 & SU,A,1 118 703 (Urals Kirov Poly), Oct. 15, 1984.*

Database WPI Section Ch, Week 8527 Derwent Publications Ltd., London, GB; Class M23: AN 85–163700 XP002007521 & SU,A,1 129 261 (Alloys Non–Ferr Metal), Dec. 15, 1984.*

ASM Handbook: Properties and Selection: Nonferrous Alloys and Special–Purpose Materials. vol. 2, pp. 15 and 17, Oct. 1995.*

*Primary Examiner*—Roy King
*Assistant Examiner*—Tima McGuthry-Banks
(74) *Attorney, Agent, or Firm*—Millen, White, Zelano & Branigan, P.C.

(57) ABSTRACT

Two methods of producing a ceramic reinforced Al-alloy metal-matrix composite are described. The first one comprises the steps of dispersing a ceramic phase (of titanium diboride) in a liquid aluminum or aluminum alloy, mixing the ceramic phase with a cryolite or other fluoride flux powder and melting the mixture together with the aluminum or aluminum alloy phase at a temperature of between 700° and 1000° C. In the second method, the fluoride flux is reduced in situ by either molten aluminum or its alloying elements (Mg, Ca) to yield $TiB_2$ crystallites of different size and size distribution that can be predetermined by fixing the flux and alloy composition and the processing temperature.

21 Claims, 3 Drawing Sheets

U.S. PATENT DOCUMENTS 4,820,339 * 4/1989 Bienvenu et al. ..... 75/684
4,842,821 * 6/1989 Banjeri et al. ..... 420/528
4,880,462 * 11/1989 Meyer-Grunow ..... 75/253
4,917,728 * 4/1990 Enright ..... 75/68
5,057,150 * 10/1991 Reeve et al. ..... 75/671
5,262,206 * 11/1993 Rangaswamy et al. ..... 427/447
5,401,338 * 3/1995 Lin ..... 148/538
5,431,876 * 7/1995 Kumar et al. ..... 420/529
5,486,223 * 1/1996 Carden et al. ..... 75/244
5,501,917 * 3/1996 Hong ..... 420/417

* cited by examiner

$TiB_2$ PARTICULATE CERAMIC REINFORCED AL-ALLOY METAL-MATRIX COMPOSITES

This invention relates to the production of $TiB_2$ ceramic particulate reinforced Al-alloy metal-matrix composites.

The benefits of light alloy materials for structural engineering applications have been realised for their strength, toughness and above all for specific modulus. Consequently the aerospace and automotive industries have reaped a considerable incentive: fuel economy and longevity of components in service. In the last two decades or so, a new type of material has emerged which is based on the reinforcement by low density, high temperature ceramic materials: namely silicon carbide, alumina and carbon fibres. The reinforcement has been achieved with these materials either in the form of particulates or as fibres, resulting in a substantial reduction in the density, coefficient of thermal expansion and improvement in the value of Young's modulus. The combinatorial effect of properties of matrix and reinforcement is therefore observed in the metal-matrix composites. Based on laboratory-scale experiments, novel metal-matrix composite fabrication techniques namely spray-forming of Al-alloy/SiC, squeeze and infiltration casting of fibre reinforced metal-matrix composites, including powder mixing and extrusion processing techniques, have emerged. See, for example, the article by T. W. Clyne and P. J. Withers: *An Introduction to Metal-Matrix Composites*, Cambridge Solid-state Science Series, Cambridge University Press, 1993, pp 318–359.

These methods offer potential benefits both in terms of profitability and materials properties. Also the laboratory methods have now been available for small-scale commercial production of materials and hence the above-described metal-matrix composite fabrication methods compete with each other.

Experimental data also points to several problems leading to the formation of defect structures such as void formation during liquid metal infiltration and fibre-metal reaction, or fibre misorientation during squeeze casting. In the spray-forming process, which is a rapid quenching of a two-phase mixture, namely liquid metal and fine ceramics, the cost of material production is high. Additionally, the spray-formed ingot requires further processing because it has a wide range of porosity, and the ingot cannot be formed into complex shapes during the spray-forming process. The cost comparison indicates that the powder extrusion route produces materials of prohibitively high cost. The new technology has nonetheless been used in the fabrication of a wide range of consumer sports items for which high production cost has so far been justified. See, for example, the article by T. W. Clyne and P. J. Withers: An Introduction to Metal-Matrix Composites, Cambridge Solid-state Science Series, Cambridge University Press, 1993, pp 459–470.

Using the above techniques, the cost of automotive and aerospace components has not yet been justified and for this reason the metal-matrix market for automotive, aerospace and other engineering applications still remains uncertain. The fabrication cost of automotive and aerospace structural engineering components however remains unfairly high, hence the market for these metal-matrix composite components has been virtually non-existent.

Apart from the high production cost of materials made by the above routes, a much more fundamental problem, related to the long-term reliability of Al—SiC components, remains unsolved, particularly for the high temperature applications. With prolonged exposure to high temperature service conditions, aluminium matrix has a tendency to react with SIC over a period of time. Aluminium carbide, which also forms readily as an embrittling layer at the matrix-reinforcement interface during liquid-state processing, is detrimental for high temperature toughness of the composite materials. Aluminium carbide is also susceptible to moisture attack and hydrolyses to aluminium hydroxide, and methane is a gaseous reaction product. This attack with moisture is known to cause corrosion around the particulates of SiC and carbon fibre-matrix interface. As a result, the component can considerably weaken. Material toughness and fatigue, being the most important properties of engineering components in motion, suffer adversely due to the presence of the embrittled layer of aluminium carbide phase. This therefore leaves a question as to the long-term high temperature structural reliability of aluminium/SiC and Al/carbon fibre composites.

Additional problems of recycling Al/SiC and Al/carbon composites also arise due to undesirable presence of silicon and carbon in the metallic phase. This is expected to create a stock-pile of non-recyclable aluminium alloy composites which will also contribute to the overall cost of the composite materials.

More recently, titanium based materials have been recognised as a promising candidate in the fabrication of metal-matrix composites. Titanium diboride and carbide have been traditionally used for grain refinement in aluminium alloys. The ceramic phase is known to adapt microstructurally with the metallic matrix, providing a significant improvement in the mechanical properties of the alloy, which is unlikely to be achieved with SiC and carbon fibre reinforcement. The diboride ceramic phase does not aggressively react with the liquid metal to form an intermediate layer of embrittled phase. The diboride phase dispersion technology using melting and casting of aluminium alloy in air is a well-proven technique for the last 50 years in aluminium industries for the fabrication of grain-refined master alloy and fine grain-size Al-alloy castings for shape forming. The grain-refining reaction is:

$$4Al_{liq}+TiB_2=Al_3Ti+AlB_2 \quad (1)$$

which is an important aspect of $TiB_2$ and related ceramic phase dispersion in the metallic phase. Both $AlB_2$ and/or mixed diboride $(Al,Ti)B_2$, which form as a result of the grain-refining reaction, are isostructural with $TiB_2$ and hence from the Hume-Rothery rule exhibit extended solubility.

This solid-solution boride phase, having an identical crystal structure as $TiB_2$, is interfacially and crystallographically compatible with the alloy matrix. This is one of the reasons that the grain-refined Al-alloy exhibits better fatigue properties because of the interlocking of grain boundaries and dislocation by complex boride phase, a feature also commonly seen in high temperature superalloys. As a result of the favourable interfacial reaction and lower solubility of complex borides in the matrix, Al—$TiB_2$ composite is microstructurally a far superior composite material capable of exhibiting better high and low temperature fatigue and fracture properties. Some of the mechanical properties of as-cast and annealed Al-alloy metal-matrix composites with $TiB_2$ are discussed in reference GB-A-2,259,308. Titanium carbide favours the improvement in the properties in the same way as $TiB_2$ but to a lesser degree.

London Scandinavian Metallurgical (LSM) Company has recently developed an in situ ceramic dispersion technique reported in GB-A-2,257,985, GB-A-2,259,308 and GB-A-2,259,309. This method uses a flux mixture of $K_2TiF_6$ and $KBF_4$ in contact with molten aluminium. The chemical procedure for dispersing $TiB_2$ in aluminium alloys is an extension of grain-refining reaction:

$$K_2TiF_6+2KBF_4+(3+\tfrac{1}{3})Al=TiB_2+(3+\tfrac{1}{3})K_3AlF_6+2AlF_3 \quad (2)$$

In this in situ technique, also referred to as the reactive casting technique, the ceramic phase ($TiB_2$) forms via chemical reaction (2) and is subsequently dispersed in the molten alloy.

The patent publications point out that the procedure has resulted in the development of cast aluminium/$TiB_2$ product with a maximum of 9 volume percent of the ceramic phase (see GB-A-2,257,985). So far there has been no further reported improvement in the volume fraction of titanium diboride phase dispersion by any other research group in the world.

According to an aspect of the present invention, there is provided a method of producing a ceramic reinforced aluminium alloy metal matrix composite comprising the steps of combining molten aluminium with molten flux in an inert atmosphere substantially free from oxygen and moisture.

The present invention can provide a method of producing a ceramic reinforced metal-matrix composite, comprising the steps of dispersing a ceramic phase in liquid aluminium or aluminium alloy, mixing the ceramic phase either exogeneously with a flux and melting the mixture together with the aluminium alloy phase for dispersion or forming insitu via reaction 2 in an inert atmosphere. Both processes yield higher volume fractions of $TiB_2$ in Al-alloys than the LSM process.

In the preferred embodiment, the dispersion of $TiB_2$ ceramic phase in liquid aluminium alloys is achieved by a technique using molten flux, in particular fluorides (there are also oxide/fluoride flux mixtures which can be used for dispersing ceramic phase in molten aluminium alloys). This is called the exsitu dispersion of $TiB_2$ ceramic particulates in Al-alloys. In this technique, the ceramic phase is mixed with a suitable flux powder and melted together with the alloy phase for dispersion in an inert atmosphere. The molten flux facilitates the dispersion of the ceramic phase in the molten aluminium by lowering the interfacial energy between the flux, metal and the ceramic phase. In the exsitu technique, the as-cast properties of Al—$TiB_2$ composites are determined by the properties of powders fed in the bath with the aid of a molten flux. The volume percent of the ceramic phase ($TiB_2$) is proportionally linked with the weight percent of $TiB_2$ in the starting flux prior to melting. The technique can therefore yield a very high volume percent (>30%) of the ceramic dispersion in the Al-alloy matrix.

In addition to the exsitu technique, based on the treatment of molten fluoride flux with molten aluminium, we have also developed a unique method for insitu formation of the ceramic phase, which can also remarkably improve ceramic phase dispersion. The new insitu technique radically differs from the reactive casting method developed at LSM in terms of the chemical compositions of the flux selected, engineered microstructure via alloy and flux composition manipulation, size and size distribution of the ceramic phase formed and the processing technique adopted. The above-described technique offers a new method for casting and shaping of metal-matrix composite ingots with a range of volume fractions of the ceramic phase dispersion. Both the size and the size distribution of the ceramic phase can also be controlled via insitu technique discussed herein. The maximum volume percent in a homogeneous structure of the ceramic phase could be as high as 60% of $TiB_2$ in Al-alloy matrix.

A number of new flux compositions hitherto unknown in the aluminium alloy cast shop were designed for enhancing the dispersion of $TiB_2$. A completely new range of Al—$TiB_2$ based materials are derived from the insitu technique in which the properties of materials cast are determined by the flux composition, chemistry of the alloy phase and the melting atmosphere.

In this new insitu dispersion technique using molten flux, metallic calcium or magnesium, either dissolved in the alloy phase or in the molten flux, reduces $MBF_4$ and $M_2TiF_6$ simultaneously to yield $TiB_2$, KF and $MgF_2$ and $CaF_2$. Here M designates Li, Na, K etc. In the flux, Mg and Ca can also be added as an ingredient for the dispersion of the ceramic phase. The flux can also be modified to incorporate Zr ions in lieu of Ti. Both Ti and Zr ions can also be present simultaneouly in the flux phase. Chemical reactions in an inert or a partially reducing atmosphere:

$$2KBF_4+K_2TiF_6+5\{Ca\}_{dissolved}=5\{CaF_2\}+4KF+TiB_2 \quad 3$$

$$2KBF_4+K_2TiF_6+5\{Mg\}_{dissolved}=5\{MgF_2\}+4KF+TiB_2 \quad 4$$

are thermodynamically more favourable than the reduction reaction of $K_2TiF_6$ and $KBF_4$ with metallic aluminium in air as proposed in the LSM process. Aluminothermic reduction of fluorides in air and oxygen-rich atmosphere is not a novel concept since this principle has been applied to aluminium alloy grain refining for the last 40–50 years. The LSM process is an extension of the grain refining reaction of aluminium alloys. A large favourable thermodynamic driving force for Al, Mg and Ca metallothermic reduction process can only be achieved for the benefit of making $TiB_2$ by ensuring a partially reducing or inert atmosphere so that the reactive metals do not oxidise and fully participate in the reduction reactions 3 and 4. The favourable thermodynamic driving force for the reduction reaction enables us to control the size of $TiB_2$ crystals in the dispersed state by controlling the nucleation process which is strongly dependent on the Gibbs free and surface energies. Air as a processing atmosphere adversely affects the dispersion process by enhancing the oxidation of $TiB_2$ dispersed in the aluminium alloy and by unfavourably changing the interfacial energy between the ceramic and metal phases.

In embodiments which use lithium and magnesium based fluoride or halide flux, this can be reduced to produce Al—Li and Al—Mg based alloys respectively.

Both exsitu and insitu methods for the ceramic phase dispersion in molten aluminium, can be readily employed to manufacture a wide range of engineering materials for automotive, aerospace and tribological applications.

Preferably, the inert atmosphere is substantially free from nitrogen. The atmosphere may contain a level of oxygen and moisture in combination of less than 1.0% volume. However, in the preferred embodiment, the atmosphere contains oxygen and moisture in combination less than 0.1% volume.

For an exsitu technique, the method may comprise the steps of dispersing a ceramic phase in liquid aluminum or aluminium alloy within the inert atmosphere, mixing the ceramic phase with the flux, the flux being operative to reduce oxygen partial pressure, and melting the mixture together with the aluminium or aluminium alloy phase for dispersion. The ceramic phase may include titanium diboride.

For the insitu technique, the method may comprise the step of dispersing titanium diboride by reducing titanium and boron bearing molten fluorides with molten aluminium or aluminium alloy or reactive metals such as Mg, Ca present in the alloy or flux.

The flux preferably includes a metallic calcium or metallic magnesium powder reducing agent. The flux may be fluoride flux and must have a solubility for oxygen in the form of alumina.

Advantageously, the flux is a cryolite formed either after insitu reaction of $M_2TiF_6$ and $MBF_4$, or other alkali or alkali-earth metal or fluorides, or added as a flux itself while melting aluminium. The method preferably includes Zr in the alloy phase as a ceramic crystal facetting agent and replacing Zr either by Hf or by Cr. The flux can be reduced by dissolved Ca or dissolved Mg or both. The aluminium alloy is preferably melted in an atmosphere of argon gas or an argon/hydrogen gas mixture.

According to another aspect of the present invention, there is provided a ceramic reinforced aluminium alloy metal matrix composite comprising micrometer to nanometer size dispersion of titanium diboride ceramic phase in the alloy.

In the preferred embodiment, the volume percent of the ceramic phase is between 0% and 60% and the particulate size of titanium diboride is less than substantially 5 $\mu$m, most preferably less than substantially 2 $\mu$m and is substantially homogeneously distributed in the matrix.

According to another aspect of the present invention, there is provided a flux for forming a ceramic reinforced aluminium alloy metal matrix composite comprising a mixture of $M_2TiF_6$ and $MBF_4$, where M is Li, Na or K. The flux may be lithium and/or magnesium based and/or may include $M'F_2$, where M' defines divalent metal ions.

According to another aspect of the present invention, there is provided apparatus for producing a ceramic reinforced aluminium alloy metal matrix composite comprising a sealed reaction chamber disposed within a furnace and means for producing within the reaction chamber an inert atmosphere substantially free of oxygen and moisture. The inert atmosphere producing means preferably includes a supply of an inert gas substantially free of oxygen and moisture. The reaction chamber preferably includes a copper reaction vessel.

BRIEF DESCRIPTION OF THE DRAWINGS

Embodiments of the present invention are described below, by way of example only, with reference to the accompanying drawings, in which.

It is to be understood that any component values or ranges given herein may be altered and/or extended without losing the effects sought, as will be apparent to the skilled reader from the teachings herein.

Figure 2A:
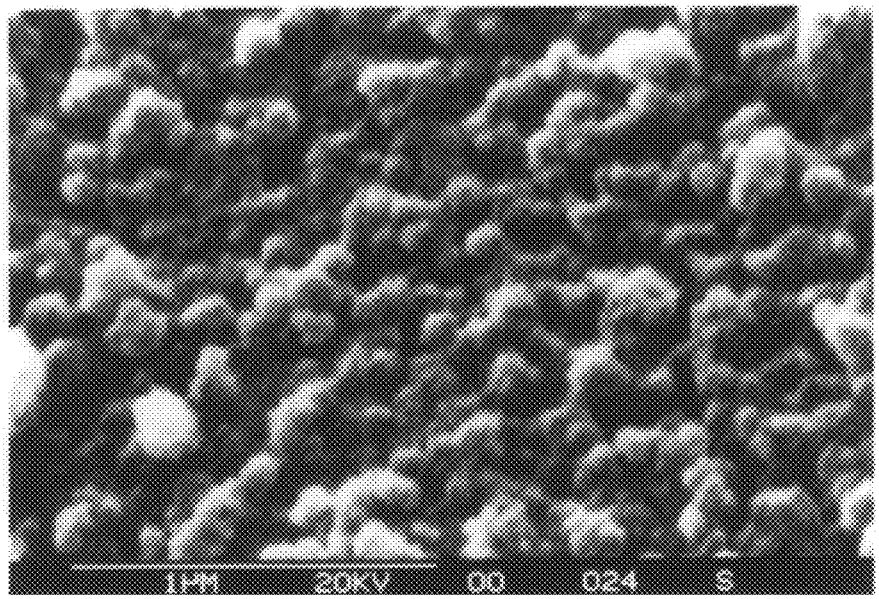
FIGS. 2*a* to 2*c* are as-cast micrographs of titanium diboride dispersed in aluminium alloys.
Figure 2B:
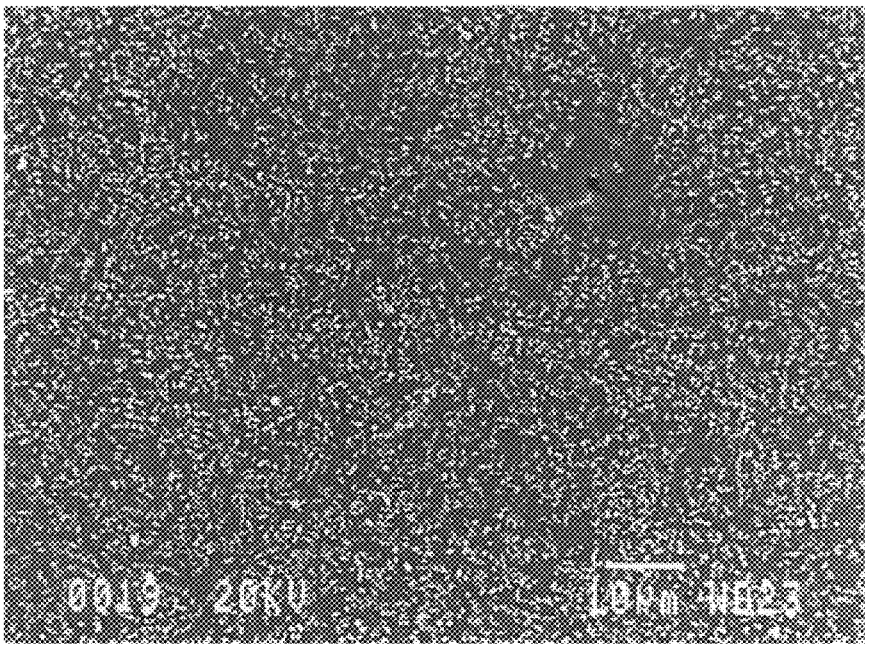

The cast metal-matrix composite microstructure described herein can be manufactured by using any suitable type of controlled atmosphere melting practice (oxygen, nitrogen and moisture-free atmosphere), as will become apparent from the teachings herein. This may be carried out, for example, in a controlled atmosphere gas-fired or induction furnace with an argon or argon/$H_2$ gas purge for maintaining a relatively low oxygen, nitrogen and moisture atmosphere in the melting vessel. In the present investigation, both inductive and resistive heating methods were adopted. FIGS. 2*a* and 2*b* are for Al—Li and Al—Mg—Zr matrix respectively whereas in the FIG. 2*c*, the microstructure of exogeneously dispersed $TiB_2$ particulates in Al-4.5 weight percent Cu is shown.

The dispersion of titanium diboride particles in a range of molten aluminium alloy was achieved by adopting the following steps. The procedure was followed for both 20 gram and 1 kilogram batch sizes of molten aluminium alloy.

a) Several types of aluminium alloys namely commercial 1xxx series, Al—Li (0–5 wt %), Al—Cu (0–5 wt %), Al—Mg (0–8 wt %) and Al—Si(0–10 wt %) were melted in an atmosphere of dry argon or argon-4%$H_2$ gas mixture. The liquid metal processing isotherm chosen between 700° and 1000° C. which could be predetermined from the liquidus temperature and the known casting temperature of a specific alloy composition.

b) While melting the alloy of specific composition, the titanium diboride powder was mixed with the fluoride flux, namely cryolite (3MF,$AlF_3$,M:Li,Na and K). The flux mixed with ceramic powder was melted with the Al-alloy for the exsitu dispersion process. Additional amount of ceramic powder was also added with the flux after the alloy was completely molten. This method permits a means to control the volume fraction of the dispersed phase.

In the insitu technique, the flux-assisted dispersion of the ceramic phase was carried out by melting various aluminium alloys and flux compositions in a low oxygen potential atmosphere by maintaining a stream of an inert gas such as Ar or Ar-4% $H_2$ gas mixture in the melting chamber. On the other hand, the apparatus shown in FIG. 1 can be used for a continuous production of metal-matrix ingots. The crucible is preferably made of water-cooled copper.

c) After a period of homogenisation above the melting point of the alloy phase, which could be between 700° and 1000° C. depending upon the alloy and flux composition, the liquid metal dispersed with ceramic phase was cooled either by pouring it out in a mould or leaving it in the melting pot to cool down slowly.

After casting, the ingots were examined to ascertain the volume fractions of the dispersed phase and the resulting properties of the metal-matrix composites. In the method described above, the desired ceramic phase is mixed with a suitable flux, preferably a fluoride flux, that preferably has a finite solubility for alumina. This alters the interfacial tension between alumina and liquid metal to provide energetically more favourable interfacial tension (s) between the ceramic phase and metal (ie $s_{Al/Cer}<s_{Al/Alumina}$) for achieving maximum dispersion. The interfacial tension condition sets constraints on the processing parameters and equipment used. The first and the foremost variable is the overall oxygen content of the flux, ceramic powder and metal which determines the oxygen potential for the stability of impervious alumina layer. The presence of an impervious layer of alumina prevents the dispersion of the ceramic phase. If impurities such as water vapour and $CO_2$ are present in the melting environment, the surface contamination of the ceramic powder by oxygen increases, thereby resulting in poor dispersion of ceramic phase in the liquid metal. For this reason, flux to be used and the atmosphere in which the process should be carried out should be substantially free from moisture and oxygen-containing impurities, which extrinsically determines the oxygen potential in the flux bath and affects the formation of impervious layer of alumina.

The preferred flux is defined as a molten phase which serves the following purposes and consequently aids the dispersion of the ceramic phase. It has the following properties:

i) preferably, it must exhibit solubility for alumina, so that oxygen present as alumina can be readily removed from the flux-molten metal interface;

ii) it is a phase that also acts as a reservoir for elements which reduce the surface energy of molten aluminium and aluminium alloys. This phase also acts as a reservoir for the reactive elements e.g. Li, Mg, Zr that can be readily dissolved in Al-alloy for making novel alloys;

iii) it is a phase that controls the nucleation process of the ceramic phase formed as a result of the reduction reaction between the metal and the flux defined in equations 2 to 4.

The flux for the insitu process is a mixture of $M_2TiF_6$ and $MBF_4$ where M is Li, Na, K. In this mixture $M'F_2$ compounds are also added. For nanometer-size range (50–100) nm dispersion of $TiB_2$, lithium based fluxes are preferred. For coarser particles of $TiB_2$ than 100 nm, flux could be a combination of $M'F_2$ and $K_2TiF_6$—$KBF_4$ mixtures. For making novel alloys, e.g. Al—Li, Al—Mg and Al—Li—Mg, the flux should consist of lithium and magnesium.

The melting atmosphere should be free from oxygen and moisture in order to minimize the formation of alumina. It is also preferred that the concentration of residual nitrogen in the inert atmosphere should be controlled in order to reduce the risk of vital components to be lost as nitrides. The preferable maximum tolerable limit for total oxygen should be less than 0.1 volume % in the gas phase. Beyond this level, the process of ceramic phase dispersion is readily impeded by the presence of an impervious layer of alumina.

It has been found that improved results can be obtained with a moisture content of less than 5% volume and an oxygen content less than 5% volume. Significantly better results are obtainable when the oxygen and moisture contents are both less than 1% volume. However, ideal results are obtained, for the insitu process, with combined oxygen and moisture levels of less than 0.1% volume; and for the exsitu process, with combined oxygen and moisture levels of less than 0.5% volume.

Results can be improved further by ensuring the processing atmosphere is substantially free of nitrogen.

The wettability between the ceramic phase and aluminium metal can also be improved by having a flux that reacts with alumina to form a complex oxyfluoride. Molten cryolite is one such flux and in an inert atmosphere melting condition it can dissolve residual levels of alumina from the flux-metal interface and encourage the dispersion of exogeneous $TiB_2$ particulates. The addition of cryolite as flux therefore improves the dispersion of $TiB_2$. The dispersion of $TiB_2$ in the presence of either hydrous or partially hydrous $KBF_4$ and $K_2TiF_6$, as shown in reaction (2), was not found to be very encouraging because these two fluorides also absorb significant quantities of moisture and consequently promote the formation of alumina at the flux-metal interface. In the presence of excess oxygen, the fluoride flux rapidly saturates with alumina; the mixture then becomes unable to remove any further alumina formed at the interface. This reduction in the capacity of alumina solubility of molten cryolite is limited in the prior art due to the use of air as processing atmosphere. The dispersion of $TiB_2$ formed as a result of fluoride flux-metal reaction remains trapped in the flux-metal interface. The presence of alumina-saturated cryolite therefore inhibits the dispersion of insitu-formed $TiB_2$. The complex ion-forming tendency of cryolite with alumina and related fluoride fluxes rapidly changes the interfacial energy between alumina and aluminium metal. The total concentrations of moisture and oxygen related impurities of fluoride flux used for dispersion should always be less than the saturation solubility of oxygen (as dissolved alumina) in the flux. If this solubility limit is low for a particular type of fluoride flux, the precipitation of alumina from flux takes place as an interfacial barrier between the metal and molten flux. This thin layer of alumina adversely affects the transport and dispersion of $TiB_2$ in molten aluminium alloys.

The flux compositions used in the dispersion of $TiB_2$ via insitu and exsitu techniques are unique. In each case, the flux compositions were found to be beneficial for the dispersion process. In particular, the presence of Li, Mg and Zr ions are preferred in the flux for aiding the dispersion of $TiB_2$ in aluminium alloys. The alloy phase surface-energy modifying elements (e.g. Li, Mg, Pb, Bi, Zr and Fe) are incorporated as important constituents of the flux. One of the following types of flux could be used for dispersion of $TiB_2$:

a halide (fluoride plus chloride) flux an oxide flux a mixture of oxide and halide flux The processing atmosphere must be dry and inert as stipulated above. The flux compositions with halides and oxides will yield similar results in terms of the lowering of surface energy of the molten aluminium and alloys as observed with fluorides. The reduction in the surface energy of the alloy phase is one of the most important roles of the flux in assisting the dispersion process. This principle is applicable to both the exsitu and the insitu processes. The reduction in the surface energy of molten aluminium and its alloys favours the condition for the nucleation of $TiB_2$ phase via insitu process which is otherwise impossible to achieve if the oxygen potential of the melting chamber is not controlled.

The microstructure of cast composites via the exsitu process can be altered by using the flux compositions that reduce the surface energy of the metallic phase. In this respect, the use of lithium and magnesium based flux will aid the dispersion of exsitu $TiB_2$. The presence of Zr in the flux is expected to produce a similar effect as does happen in the insitu process with Al-8% Mg-1% Zr alloy.

The wettability of the ceramic phase by Al-alloy also determines the selection criterion for the crucible material. Graphite as a containment material for molten aluminium alloy and flux is only suitable for achieving dispersion preferentially on the surface of the metal. This arises due to a lower value of $s_{Al/TiB2/C}$ than $s_{Al/TiB2}$ in the presence of molten cryolite. Consequently ceramic dispersion was achieved only on the surface of the alloy ingot at all temperatures. So far we have not found any fluoride flux that provides extensive dispersion in the entire volume of metal while being held inside a graphite crucible in spite of the fact that graphite is an oxygen-getter and will suppress the formation of alumina. Its role in reducing oxygen partial pressure by forming $CO_2$ or CO gas at the interface can be readily appreciated from the thermodynamic considerations. The removal of interfacial oxygen will therefore affect the interfacial tension which is then lowered in favour of surface dispersion of $TiB_2$ at the metal-crucible interface because $s_{Al/TiB2/C}$ is lower than $s_{Al/TiB2}$.

The use of alumina as crucible material, with cryolite as flux is beneficial. This is based on the principles of interfacial energy described above. By using alumina as a crucible material, a significant improvement in the ceramic dispersion in the molten aluminium has been observed. The reason is that the $s_{alumina/cryolite}$ interfacial tension dominates at the crucible wall-flux boundary region due to which the interfacial tension between $s_{alumina/flux/TiB2}$ is artificially raised. This rise in the surface energy difference between $s_{alumina/cryolite}$ and $s_{alumina/flux/TiB2}$ encourages the surface-induced migration of $TiB_2$ from the alumina/flux/$TiB_2$ boundary near the crucible wall to energetically more favourable Al/$TiB_2$ boundary in the bulk metal.

Our understanding of interfacial energy between the ceramic and metal phase has been developed from the first principle that invokes the theory of interfacial bonding. All alloying elements that reduce the surface energy of molten aluminium aid the dispersion process. This factor enables us to design alloys that would provide a range of microstructures of the dispersed phase in the aluminium alloy matrix. The presence of certain alloying elements such as Li, Mg, Zr, Bi, Pb, Fe and Ti achieves a higher dispersion of $TiB_2$ in Al-alloys. However copper and silicon do not alter the surface tension of liquid aluminium significantly compared with Li, Mg, and Zr. The presence of an alloying element also has an implication on the selection of the matrix material for achieving a higher value of specific modulus. The alloying elements that exhibit a strong compound-forming tendency improve the wettability and dispersion of the ceramic phase in general in aluminium alloys. For this reason, we have particularly selected Al—Mg and Al—Li alloys as low-density matrix materials. On the basis of the reduction in interfacial energy due to the presence of an alloying element, it has been also demonstrated that Al—Cu alloy matrix is a less effective matrix material than Al—Mg system. In this respect, the presence of Li in liquid aluminium has been found to be more effective in achieving high dispersion volume of $TiB_2$. The surface energy modifying elements can be incorporated in the melting process either via the flux or via the metal. The presence of Zr aids the morphological changes and the coarsening of $TiB_2$ particulates formed insitu via reaction 1 to 4 continues after nucleation. Cr, Hf and other boride formers are expected to produce similar effects. The tendency for facetting of $TiB_2$ crystals is observed in the presence of Zr as alloying element in Al-alloys.

The dispersion of titanium diboride ($TiB_2$) has also been achieved by using a mixture of fluoride flux based on $KBF_4$, $LiBF_4$, $K_2TiF_6$ and $Li_2TiF_6$ and KF, $MgF_2$, LiF and their variants. The presence of lithium in the molten fluoride flux (or in metal and or in both phases) can achieve copious nucleation of very fine $TiB_2$ ceramic phase in molten aluminium alloy. An example is shown in FIG. 2*a*. Furthermore, this concept, based on the understanding of surface energy has also led to a development of dissolving alloying elements such as lithium, magnesium and calcium in molten aluminium which cannot be easily dissolved in elemental forms. The flux-assisted aluminothermic reduction is also a novel method for making Al—Li, Al—Mg, Al—Li—Mg alloys and their composites.

The flux-assisted alloying element dissolution techniques (as discovered from our ceramic dispersion experiments) using two types of flux mixtures, namely ($K_2TiF_6$—$KBF_4$): 97 wt % and 3 wt % LiF and $\{K_2TiF_6,KBF_4\}_{0.8}$—$\{Li_2TiF_6—LiBF_4\}_{0.2}$ have yielded 0.45 wt % and 4.5 wt % Li respectively in commercially pure molten aluminium. The chemical analysis was performed on the solidified ingot after thoroughly cleaning the flux from the ingot surface. This method of ensuring high concentration of dissolved Li and Mg in commercial aluminium alloy is particularly attractive for the production of a range of alloy compositions for structural applications. The presence of fluoride flux particularly reduces the hydrogen gas pick up of Al—Li alloy which is known to be a major problem in making defect-free castings of aluminium-lithium alloy.

Figure 2C:
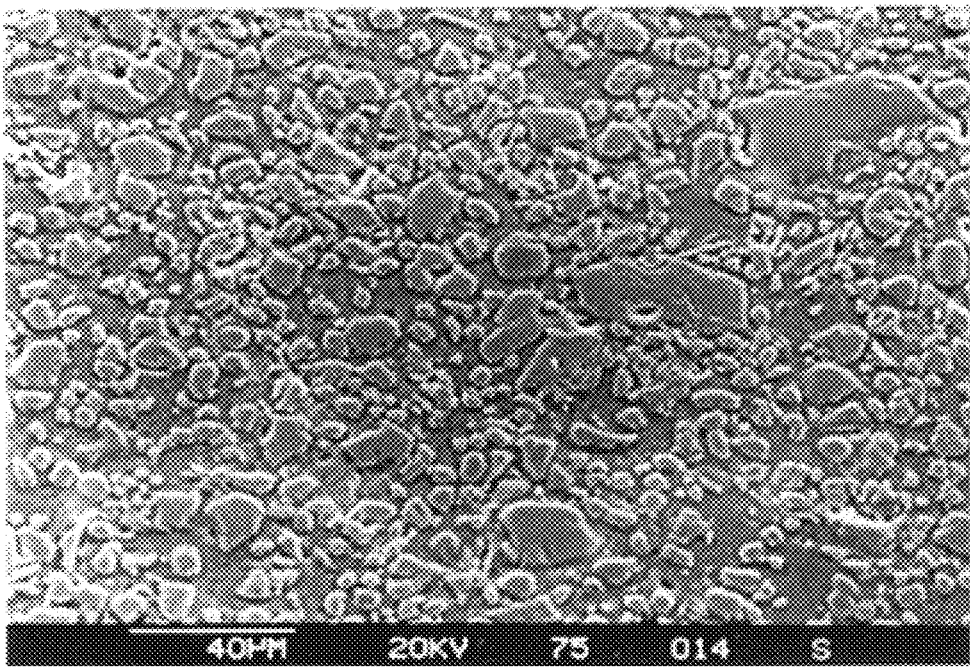

In the preferred fluoride-flux ceramic dispersion process the surface-active alloying elements such as Li and Mg also contribute to the modification of the morphology of the insitu formed $TiB_2$ ceramic phase. Our results show that the presence of Mg and Zr in the alloy phase leads to the growth of faceted $TiB_2$ crystals which disperse homogeneously in the Al-alloy. The segregation of $TiB_2$ at the grain boundary is minimized in the presence of Mg which contrasts with the presence of copper. FIG. 2*a* shows micrograph of $TiB_2$ dispersed in Al-4.5 wt % Li alloy using an insitu dispersion technique. Flux composition was 80 wt % of stoichiometric mixture ($K_2TiF_6$+$KBF_4$) and 20 wt % of the stoichiometric mixture ($Li_2TiF_6$—$LiBF_4$). Submicrometer size of $TiB_2$ clustres formed and dispersed throughout the ingot. In these clustres, the size of $TiB_2$ particulates appears to be in the region of 50 to 100 nm. The micrometer bar in FIG. 2*a* should be referred to for comparing the size of $TiB_2$ crystallite clusters. FIG. 2*b* shows an extensive dispersion of faceted shape $TiB_2$ in Al—Mg (8 wt %)-Zr(1 wt %) alloy using an insitu dispersion technique. The flux used was 100 wt % $K_2TiF_6$—$KBF_4$. FIG. 2*c* is an example of the dispersion of $TiB_2$ via an exsitu technique in an Al-4.5 wt % Cu alloy. The particulates of $TiB_2$ were dispersed exogeneously in a sodium cryolite flux.

The presence of lithium on the other hand, enhances the nucleation of $TiB_2$ and submicrometer size $TiB_2$ (50 nm<f<500 nm) particulates form. In designing Al-alloy metal-matrix composites, the combined effect of the presence of lithium and magnesium in the alloy phase for morphological engineering is strongly recommended. This can be effected by mixing lithium and magnesium fluoride fluxes with potassium fluoride fluxes. The size and size distribution of the titanium diboride particulates formed insitu also depends upon the relative proportions of fluoroborate ($MBF_4$) and fluorotitanate ($M_2TiF_6$) and fluorides ($M'F_x$). Here M designates Li, Na and K elements in complex fluorides whereas M' designates Mg, Ca, K, Li and Na ions.

Figure 1:
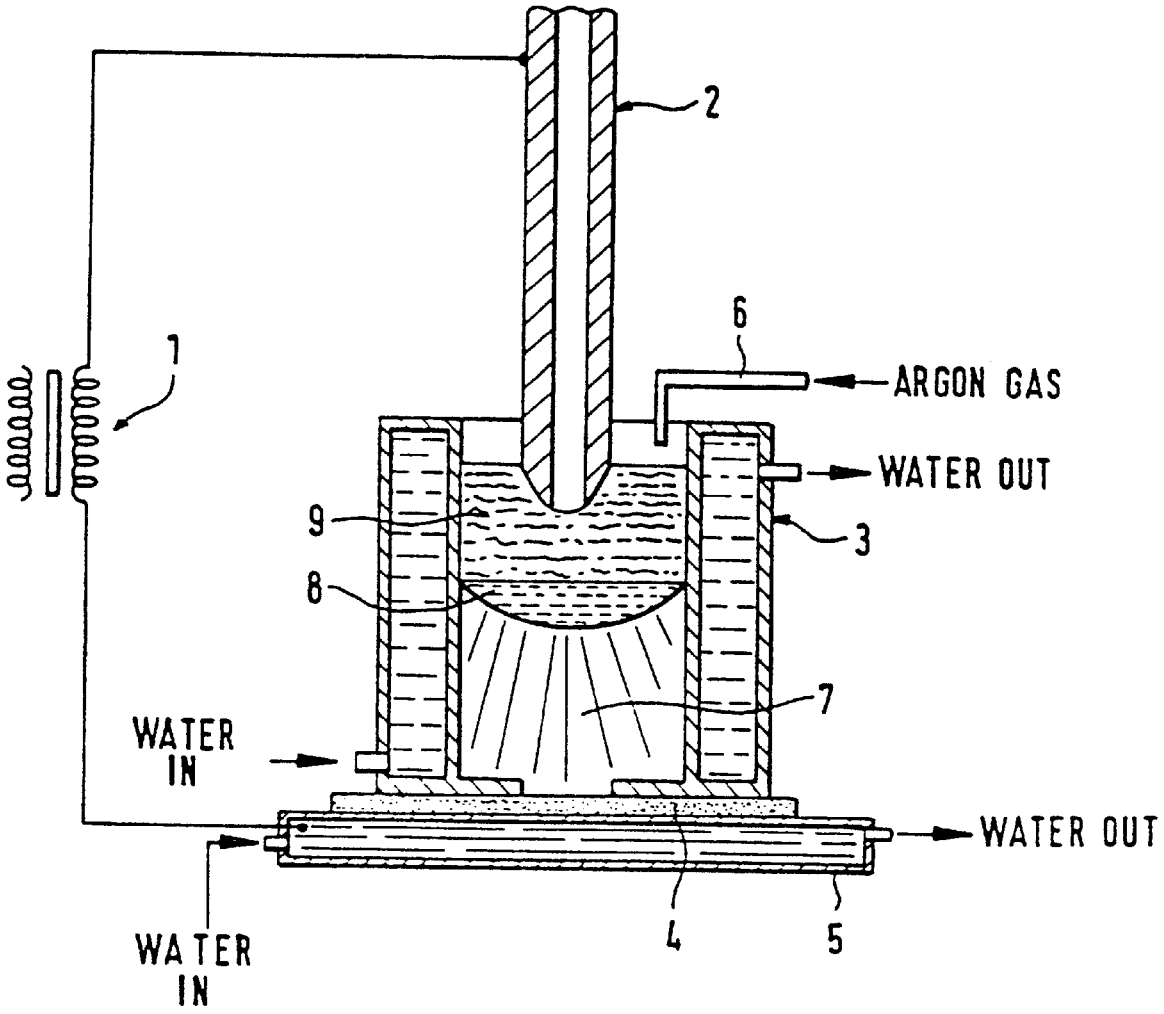
FIG. 1 is a cross-sectional view of an example of water-cooled copper crucible typically used for the preferred electro-flux melting and remelting process.

The above principles can be adopted and applied to a wide range of ceramic phase dispersion in both aluminium and Al-alloy matrix. For achieving higher volume fractions of ceramic dispersion in the metallic matrix, the following methods have been developed:

a) Dispersion of the ceramic phase in the molten metal has been achieved by using a suitable fluoride flux. This can be a cryolite or any other fluoride or nonfluoride flux that satisfies the interfacial tension conditions outlined above. The melting of matrix alloy can be carried out using an induction coil, or a gas-fired furnace or a muffle furnace or in an electroflux remelting unit as shown in FIG. 1. Either after melting or during melting of aluminium, the dispersion could be initiated using an appropriate flux as long as the conditions for maintaining oxygen partial pressure and interfacial tensions are met. After dispersing the ceramic phase, the two-phase mixture of ceramic with metal can be cast into a suitable geometry by adopting any commercial casting method eg chill casting, gravity die casting or sand casting. The dispersion can also be achieved via molten $K_2TiF_6$ and $KBF_4$ or any other fluoride flux mixtures described above with exogeneous $TiB_2$ as a nucleation-promoting phase.

b) Direct arc melting using a hollow aluminium electrode can be adopted to build metal and flux volume in a water-cooled copper crucible. An example is shown in FIG. 1. From this method, the benefits of a directionally solidified microstructure can be harnessed. Referring to FIG. 1, the apparatus shown includes a power supply 1 coupled to a hollow electrode, in this case of aluminium or aluminium alloy, and to a water-cooled copper plate 5. A water cooled copper crucible 3 rests on a graphite plate 4 which in turn rests on the copper plate 5. Argon gas is fed into the crucible 3 by a delivery tube 6. Metallic liquid ceramic mixture 8 and molten flux 9 are provided in the copper crucible containing solidified ingot 7. The crucible 3 is designed so as to be able to create, with the atmosphere source 6, an atmosphere within the crucible which is substantially free of oxygen, moisture and, preferably, nitrogen. It can thus be said that the apparatus includes means to provide a reaction atmosphere substantially free of oxygen, moisture and, preferably, nitrogen.

The method proposed is similar to electro-slag refining or remelting procedure developed for the processing of high temperature alloys. The flux and ceramic phase can be injected in the molten metal through the hollow consumable aluminium alloy electrodes. The ceramic injection in the metal phase will ensure the uniform distribution of particles. Two main advantages of the process are: i) the control of ceramic volume fraction and ii) directionally solidified microstructure. We also expect a higher volume production rate than the spray-forming process by using this technique with a comparable cost of the finished product.

c) Insitu and exsitu dispersion of ceramic phase in aluminium alloy can be concomitantly achieved via cryolite-calcium fluoride/Ca or Mg metal/$TiB_2$ mixture in the molten state. Alternatively either Al—Mg rich or Al—Ca rich or Al—Li alloy phase can be melted with the above-named flux compositions (cryolite mixed with $KBF_4$/$K_2TIF_6$ or any other variation of $CaF_2$/cryolite and potassium lithium magnesium fluoroborate/titanate flux) and $TiB_2$ to achieve a high volume fraction dispersion.

The apparatus shown in FIG. 1 is flexible in producing a wide variety of aluminium alloy metal-matrix composites. In this apparatus, the atmosphere during melting can be controlled by passing different purity grades of inert gas. The flux can be melted by striking an arc between the consumable aluminium electrode, which may or may not be hollow, and the base metallic copper (water-cooled) electrode.

The arcing produces molten aluminium and flux. The flux may also be fed via hollow electrode once melting condition is stabilized i.e. a sufficient volume of metal and flux is in physical contact. Additional solid or molten flux can be fed periodically to achieve a uniform volume percent of $TiB_2$ in the matrix. The matrix is directionally solidified by extracting heat from the bottom of the ingot in contact with the base plate. After the arcing period, the material melts under resistive heating as in electro-flux refining process. The volume percent of ceramic phase can be varied from one operaion to another or along the length of cast ingot by controlling the volume of titanium diboride (for exsitu or titanium and boron for insitu process).

It will be apparent to the skilled reader that in the exsitu method the particle size of the $TiB_2$ dispersion is dependent upon the size of the particulate added via the flux. On the other hand, in the insitu technique, the particle size of the $TiB_2$ dispersion is determined by alloy and flux manipulation. In both methods, substantially uniform distribution of $TiB_2$ has been achieved.

The advantages of the preferred method a re as follows:

a) Dispersion of $TiB_2$ in aluminium alloy matrix namely 1xxx alloy, (Al-4 wt %Cu), (Al—Mg) and Al—Li can be achieved. The maximum volume percent achieved so far exceeds 50% volume.

b) Both the insitu and exsitu techniques can be simultaneously effected for the fabrication of metal-matrix composites. Such an electro-flux remelting technique using a hollow aluminium alloy electrode will yield a new technique for continuous production of metal-matrix composite ingots with a mechanism for controlling the morphology of the ceramic phase and their phase volume in molten aluminium alloys.

c) Conventional Al-alloy foundry melting and casting equipment can be used for making a range of Al—$TiB_2$ with engineered microstructure.

Mmc products derived from the treatment of the fluxes described with molten, the described aluminium and aluminium alloys can have:

micrometer-to-nanometer size dispersion of $TiB_2$ in the matrix alloy, volume percent of ceramic phases ranges between 0% and 60%, cast structures with both wide and narrow particle size distribution of $TiB_2$ reinforcing phase, products derived from the exsitu process can have a coarser microstructure than the insitu process: the minimum particulate size of $TiB_2$ being less than 5 $\mu$m, products derived from the insitu process using Al—Mg—Zr alloy can yield a uniform size of $TiB_2$ (<2 $\mu$m) which is homogeneously distributed in the matrix, products derived from Li-containing flux can yield ultrafine microstructure (<100 nm) of $TiB_2$ in the aluminium alloy matrix, products such as Al—Li, Al—Mg and Al—Li—Mg alloys can be manufactured via the treatment of molten aluminium with Li, Mg and Li—Mg containing flux compositions.

Just some of the applications of titanium diboride produced by the above methods are given below.

a) Small volume percent containing less than 5 vol % of $TiB_2$ in master grain refining alloy rods can be directly used in DC casting. The size of $TiB_2$ can be controlled in the grain refiner in order to suppress the sedimentation of high density $TiB_2$ in the molten aluminium bath, thereby reducing a premature fade in the grain refining action. The presence of ultrafine $TiB_2$ in the aluminium alloy will exclude the need for adding a grain refiner in the holding furnace prior to casting.

b) A wide variety of Al-alloy mmc can be manufactured via the above casting techniques for automotive and aerospace applications. These could be a light alloy metal-matrix composite (eg Al—Li/$TiB_2$) for the under-carriage and fuselage structures in the civil aircraft. The size of $TiB_2$ could be reduced to less than 100 nm in order to take advantage of efficient dislocation interaction. The small size $TiB_2$ particulates will also set the upper limit of the volume fraction of $TiB_2$ phase which may be as low as 2–3 vol %. At such a low volume fraction of the ceramic phase, the specific strength and the modulus will be maintained at a high value due to the submicroscopic features such as efficient disloaction interaction and coherent matrix-ceramic phase boundary. The small upper limit of the volume fraction of $TiB_2$ particulates in Al-alloy matrix will also favour the complex shape-forming process.

c) For automotive applications, cylinder liners, valves and brake discs can be cast using conventional foundry equipment. All of these require a combination of high thermal conductivity, high-temperature strength and fracture toughness. The thermal mismatch in Al/$TiB_2$ composite is significantly smaller than Al/SiC because of a smaller differential in the expansion coefficient between Al and $TiB_2$ than in Al—SiC.

d) Aluminium-lithium, Al—Mg and Al—Li—Mg alloys can be formed via this technique by treating the metal with fluoride flux for reducing the hydrogen solubility in the molten alloy.

e) High volume percent $TiB_2$ containing the metal-matrix composite can also be used for power transmission cables. $TiB_2$ has a comparably higher electrical conductivity than either alumina or SiC.

f) The use of high $TiB_2$ containing metal-matrix composites is also in the area of tribology. For example, the parts of high-speed sea-water discharging pump can be manufactured by using mmc described above. These materials can also used as brake pads for high and moderate-speed trains.

The disclosures in British patent application no. 9506640.3, from which this application claims priority, and in the abstract accompanying this application are incorporated herein by reference.

What is claimed is:

1. A method of producing a ceramic reinforced alloy metal matrix composition by dispersing a ceramic phase in liquid aluminum or aluminum alloy within an inert atmosphere substantially free from oxygen and moisture, comprising the steps of mixing the ceramic phase with a flux, said flux being operative to reduce oxygen partial pressure, and melting the mixture together with the aluminum or aluminum alloy phase for dispersion.

2. A method according to claim 1, wherein the atmosphere contains a level of oxygen and moisture in combination less than 0.5% volume.

3. A method according to claim 1, wherein the atmosphere contains oxygen and moisture in combination less than 0.1% volume.

4. A method according to claim 1, wherein the ceramic phase includes titanium diboride.

5. A method according to claim 1, wherein the flux is a fluoride flux and has a solubility for alumina.

6. A method according to claim 5 including the step of using a ceramic crystal faceting agent in the alloy phase selected from a group consisting of Zr, Hf and Cr.

7. A method according to claim 1, wherein the aluminium alloy is melted in an atmosphere of argon gas or an argon/hydrogen gas mixture.

8. A method according to claim 1, wherein the melting temperature is fixed from the liquidus temperature and the known casting temperature of a specific alloy composition.

9. A method according to claim 1, wherein the melting temperature is between 700° C. and 1000° C.

10. A method according to claim 1 wherein an additional amount of ceramic phase is added with flux to said melted mixture and the aluminum or aluminum alloy phase after the aluminum or aluminum alloy becomes completely molten.

11. A method according to claim 10, wherein the flux and ceramic phase are injected in the molten metal through a hollow electrode.

12. A method according to claim 1, wherein after a period of homogenization above the melting point, the liquid metal dispersed with ceramic phase is cooled either by pouring it out in a mould or by leaving it in a melting chamber to cool down slowly.

13. A method according to claim 1, wherein the melting of matrix alloy is carried out using an induction coil, a gas-fired furnace or a muffle furnace.

14. A method according to claim 1, wherein the metal and flux melt is produced by direct arc melting using a hollow aluminum or aluminum alloy electrode in a water-cooled crucible.

15. A method according to claim 1, wherein the dispersion of the ceramic phase is assisted by providing lithium within the mixture.

16. A method according to claim 1 wherein the flux forming the ceramic reinforced aluminum alloy metal matrix composite comprises a mixture of $M_2TiF_6$ and $MBF_4$, where M is Li, Na or K and the flux is lithium and/or magnesium based.

17. A method according to claim 16 wherein the flux includes $MgF_2$.

18. A method according to claim 1 wherein the flux includes a metallic calcium or metallic magnesium powder reducing agent.

19. A method according to claim 1 wherein the flux is reduced by dissolved Ca or dissolved Mg or both.

20. A method according to claim 19, wherein the aluminum alloy includes one or more of the following: commercial 1xxx series, Al—Li (0–5 wt %), Al—Cu (0–5 wt %), Al—Mg (0–8 wt %) and Al—Si (0–10 wt %).

21. A method according to claim 1, comprising the step of using a melting chamber formed from alumina, graphite or copper.

* * * * *